US006109982A

United States Patent [19]

Okabe et al.

[11] Patent Number: 6,109,982

[45] Date of Patent: Aug. 29, 2000

[54] PRESS-CONNECTING CONNECTOR AND METHOD FOR ASSEMBLING THE SAME

[75] Inventors: Toshiaki Okabe; Hitoshi Kayahara, both of Shizuoka, Japan

[73] Assignee: Yazaki Corporation, Tokyo, Japan

[21] Appl. No.: 09/175,340

[22] Filed: Oct. 20, 1998

[30] Foreign Application Priority Data

Oct. 20, 1997 [JP] Japan ..... 9-287231

[51] Int. Cl.[7] ..... H01R 13/432

[52] U.S. Cl. ..... 439/748; 439/595

[58] Field of Search ..... 439/748, 746, 439/877, 744–745, 747, 749, 397–400, 594, 595, 843, 872; 29/863, 564.2

[56] References Cited

U.S. PATENT DOCUMENTS 4,214,361 7/1980 Coldren et al. ..... 439/748
4,726,792 2/1988 Shindo ..... 439/748

FOREIGN PATENT DOCUMENTS 1-253182 10/1989 Japan ..... H01R 43/00

*Primary Examiner*—Renee Luebke
*Assistant Examiner*—Antoine Ngandjui
*Attorney, Agent, or Firm*—Sughrue, Mion, Zinn Macpeak & Seas, PLLC

[57] ABSTRACT

A press-connecting connector comprises a press-connecting terminal having a press connecting portion to which an electric wire is press-connected, a connector housing having a terminal receiving chamber for receiving the press-connecting terminal, a first engaging member for engaging with the press-connecting terminal which is completely inserted into the terminal receiving chamber and for maintain the complete insertion condition of the press-connecting terminal, a second engaging member for engaging with the press-connecting terminal at least the press-connecting portion of which is exposed exterior of the terminal receiving chamber when the press-connecting terminal is disengaged from the first engagement member.

10 Claims, 4 Drawing Sheets

PRESS-CONNECTING CONNECTOR AND METHOD FOR ASSEMBLING THE SAME

BACKGROUND OF THE INVENTION

The present invention relates to a press-connecting connector and a method for assembling the same.

A press-connecting connector is assembled by inserting press-connecting terminals, each having a electric wire connected thereto, respectively into a plurality of terminal receiving chambers formed in a housing. FIGS. 6 to 8 show the process of assembling a conventional press-connecting connector, disclosed in Unexamined Japanese Patent Publication No. Hei 1-253182, in the order of steps thereof, and FIG. 6 shows a condition during the assembling, FIG. 7 shows the cross-section of the housing, and FIG. 8 shows a condition after the assembling.

A plurality of terminal receiving chambers 2 are formed in a housing 1, and press-connecting terminals 3 are inserted respectively into the terminal receiving chambers 2. Each press-connecting terminal 3 is so inserted that a press-connecting portion 5 to be connected to an electric wire 4 is exposed to the exterior of the housing 1, as shown in FIG. 6, and in this condition the press-connecting terminal 3 is provisionally retained on the housing 1, Then, in the provisional retaining condition of FIG. 6, the connector is fed to an electric wire press-connecting line, and in this electric wire press-connecting line, the electric wires 4 (see FIG. 8) are connected respectively to the press-connecting terminals 3. After the electric wires 4 are thus connected, the whole of each press-connecting terminal 5, including the press-connecting portion 5, is completely inserted into the terminal receiving chamber 2, and is fixed to the housing 1, thereby completing the connector as shown in FIG. 8.

For provisionally retaining the press-connecting terminals 3 on the housing 1 and for fixing the press-connecting terminals 3 to the housing 1, provisional retaining holes 6 and fixing holes 7 (see FIG. 7) are formed through an upper wall of the housing 1, and a projected pawl 8 for engagement in the provisional retaining hole 6 and the fixing hole 7 is formed on each of the press-connecting terminals 3.

In the provisional retaining condition of FIG. 6, the projected pawl 8 of the press-connecting terminal 3 is engaged in the provisional retaining hole 6, and serves to prevent accidental movement of the press-connecting terminal 3 during the press-connection of the electric wire 4. When the press-connecting terminal 3 is completely inserted after the electric wire 4 is connected thereto, the projected pawl 8 is engaged in the fixing hole 7 to fix the press-connecting terminal 3, as shown in FIG. 8.

However, the conventional press-connecting connector is fed to the electric wire press-connecting line, with the press-connecting portions 5 exposed to the exterior of the housing 1, and therefore the press-connecting portions 5 are liable to contact external members, and therefore are deformed or damaged by this contact. As a result, there has been encountered a problem that the electric wire can not be accurately press-connected to the press-connecting portion 5, so that the rate of defective products due to incomplete contact increases.

SUMMARY OF THE INVENTION

The present invention therefore seeks to solve the above problem of the conventional construction, and an object of the invention is to provide a press-connecting connector, as well as a method for assembling the press-connecting connector, in which the rate of defective products can be reduced.

In order to achieve the above object, there is provided a press-connecting connector comprising: a press-connecting terminal having a press connecting portion to which an electric wire is press-connected; a connector housing having a terminal receiving chamber for receiving the press-connecting terminal; a first engaging member for engaging with the press-connecting terminal which is completely inserted into the terminal receiving chamber and for maintaining the complete insertion condition of the press-connecting terminal; a second engaging member for engaging with the press-connecting terminal at least the press-connecting portion of which is exposed exterior of the terminal receiving chamber when the press-connecting terminal is disengaged from the first engagement member.

In this press-connecting connector, when the first engagement member is brought into the engaged condition, the press-connecting terminal is fixed to the housing in such a manner that the press-connecting terminal is completely inserted in the terminal receiving chamber without being exposed to the exterior of this chamber. When the second engagement member is brought into the engaged condition, the press-connecting terminal is fixed to the housing in such a manner that the press-connecting portion is exposed to the exterior of the terminal receiving chamber. Therefore, in accordance with the assembling steps for the press-connecting connector, the condition of insertion of the press-connecting terminal in the terminal receiving chamber can be changed.

Therefore, before the electric wire is press-connected to the press-connecting portion, the whole of the press-connecting terminal is completely inserted in the terminal receiving chamber, and in this completely-inserted condition, the connector is supplied to the electric wire press-connecting line, and by doing so, the press-connecting portion is prevented from contact with external members, and the deformation and damage of the press-connecting portion due to such contact are eliminated. In this case, also, the first engagement member is in the engaged condition, and therefore the press-connecting terminal is fixed to the housing, and will not be withdrawn from the housing.

When the electric wire is to be press-connected to the press-connecting portion, the engaged condition of the first engagement member is canceled, and the press-connecting portion is drawn from the terminal receiving chamber so as to bring the second engagement member into the engaged condition. With this engagement, the whole of the press-connecting terminal is fixed to the housing, and therefore the press-connecting portion will not move, and the electric wire can be positively press-connected to the press-connecting portion.

After the electric wire is thus press-connected, the whole of the press-connecting terminal is completely inserted into the terminal receiving chamber so as to bring the first engagement member into the engaged condition, so that the press-connecting terminal, having the electric wire connected thereto, can be fixed to the housing.

The press-connecting connector may further comprises a third engagement member for engaging with the press-connecting terminal simultaneously with the second engaging member so as to prevent the press-connecting terminal from moving inside of the terminal receiving chamber, the third engagement member arranged in different portion from where the second engagement member is arranged.

The third engagement member prevents the movement of the press-connecting terminal into the terminal receiving chamber. On the other hand, the second engagement member fixes the press-connecting terminal in such a manner that the press-connecting terminal is kept in an exposed condition, and the engagement of the second engagement member and the engagement of the third engagement member are effected simultaneously with each other, thereby preventing the press-connecting terminal from movement in the opposite (normal and reverse) directions. Therefore, the press-connecting terminal can be located in a predetermined position, and the electric wire can be positively press-connected to the press-connecting terminal.

In the press-connecting connector, the first engagement member may include a first engagement hole formed on an inner face of the terminal receiving chamber and a first resilient projection projected from the press-connecting terminal to engage with the first engagement hole, and wherein the second engagement member includes a second engagement hole formed on the inner face of the terminal receiving chamber so as to be spaced from the first engagement hole in a longitudinal direction thereof and a second resilient projection for engaging with the second engagement hole, the second resilient projection is projected from the press-connecting terminal so as to be spaced from first resilient projection in a longitudinal direction thereof.

Each of the first engagement member and the second engagement member is thus constituted by the engagement hole, formed in the housing, and the resilient projection formed on the press-connecting terminal, and with this construction the engagement can be effected easily and positively.

Since the engagement hole of the second engagement member is spaced from the engagement hole of the first engagement member in the longitudinal direction of the terminal receiving chamber, when the press-connecting terminal is drawn, the second resilient projection on the terminal can be engaged in the engagement hole of the second engagement member, so that the press-connecting portion is kept in an exposed condition.

In the press-connecting connector, the third engagement member may include a third engagement hole formed on the inner face in which the first engagement hole is formed and the first resilient projection for engaging with the third engagement hole.

The first resilient projection of the first engagement member also serves as the third engagement member, and this first resilient projection is engageable in the third engagement hole, and therefore there is no need to provide an additional member for engagement in the third engagement hole, which simplifies the construction.

In the press-connecting connector, the first engagement hole may be formed on a first inner face of the terminal receiving chamber and the second engagement hole may be formed on a second inner face opposing to the first inner face.

In this construction, the first and second engagement holes are formed respectively in the inner faces of the terminal receiving chamber which are opposed to each other, and therefore the first and second resilient projections, engageable respectively in these engagement holes, can be provided respectively on opposite sides of the press-connecting terminal. Therefore, the resilient projection, which is not engaged in the engagement hole, resiliently contacts the inner face, and urges the other resilient projection into engagement with the engagement hole. Therefore, the other resilient projection can be positively engaged in the engagement hole, and the engaged condition is stable.

In the press-connecting connector, both of the first and second resilient projections may be slantingly projected backwards with respect to the insertion direction of the press-connecting terminal.

Accordingly, these resilient projections will not affect the insertion of the press-connecting terminal into the terminal receiving chamber.

In the present invention a method for assembling the above press-connecting connector is also adopted. The method comprises the steps of: inserting the press-connecting terminal member completely into the terminal receiving chamber to be engaged with the first engagement member for a provisional fixation to the connector housing; withdrawing the press-connecting terminal member from the terminal receiving chamber to be engaged with the second engagement member to expose the press-connecting portion to exterior of the terminal receiving chamber; press-connecting the electric wire onto the exposed press-connecting portion; and inserting the press-connecting terminal member, of which the electric wire is connected, completely into the terminal receiving chamber to be engaged with the first engagement member for a complete fixation to the connector housing.

In the step of provisionally fixing the press-connecting terminal member in this method, the whole of the press-connecting terminal member is completely inserted into the terminal receiving chamber, and also the press-connecting terminal member is fixed to the housing by the engagement of the first engagement member. With this provisional fixation, the press-connecting terminal member is prevented from being exposed to the exterior of the housing, and therefore the press-connecting terminal member will not contact external members, and the deformation and damage due to such contact can be prevented.

In the step subsequent to the step of provisional fixation, the press-connecting terminal member is drawn so as to expose the press-connecting portion to the exterior of the terminal receiving chamber, and also the second engagement member is brought into the engaged condition. With the engagement of the second engagement member, the press-connecting terminal member is fixed in the predetermined position relative to the housing, and therefore the electric wire can be positively press-connected to the press-connecting portion at the subsequent step.

In the step subsequent to the step of press-connecting the electric wire, the press-connecting terminal member is again inserted into the terminal receiving chamber so as to bring the first engagement member into the engaged condition, and by doing so, the press-connecting terminal member is fixed to the housing, thus assembling the press-connecting connector. The assembling can be achieved through the above steps without deforming and damaging the press-connecting portion.

In the method, the press-connecting terminal member may include a plurality of press-connecting terminals and a chain terminal member for connecting the terminals, and the chain terminal member may be separated from the terminals after the step of the provisional fixation of the press-connecting terminal member. Alternatively, the chain terminal member may be separated from the terminals after the step of the press-connecting of the electric wire.

The plurality of press-connecting terminals are formed on the chain terminal member, and the press-connecting terminals, formed on the chain terminal member, are inserted respectively into the terminal receiving chambers, so that. the plurality of press-connecting terminals can be provisionally fixed at the same time. Then, after the press-connecting terminals are provisionally fixed to the housing, or after the electric wire is press-connected to the press-connecting portion of each terminal, the press-connecting terminals are separated from the chain terminal member, so that the press-connecting terminals become independent of one another, and thus the individual press-connecting terminals are mounted in the housing. By effecting the assembling operation, using the chain terminal member, the plurality. of press-connecting terminals can be simultaneously mounted in the housing, and the efficiency of the operation is enhanced.

In the method, the press-connecting connector, in which the press-connecting terminal member is provisionally fixed, is supplied to an electric wire press-connecting line, and succeeding steps are executed on the line.

When the press-connecting terminal member is provisionally fixed to the housing, the press-connecting terminal is completely inserted in the terminal receiving chamber, and therefore is not exposed to the exterior. Therefore, when the press-connecting connector is supplied to the electric wire press-connecting line, the press-connecting terminal member will not contact external members, and the deformation and damage of the press-connection terminal member due to such contact are eliminated, and the subsequent steps can be carried out smoothly.

DETAILED DESCRIPTION OF THE PREFERRED EMBODIMENT

FIGS. 1 to 5 show a process of assembling one preferred embodiment of a press-connecting connector of the present invention in the order of steps thereof. In this embodiment, by supplying a chain terminal 11 to a housing 12, a plurality of press-connecting terminals 13 can be mounted simultaneously in the housing 12.

Figure 1:
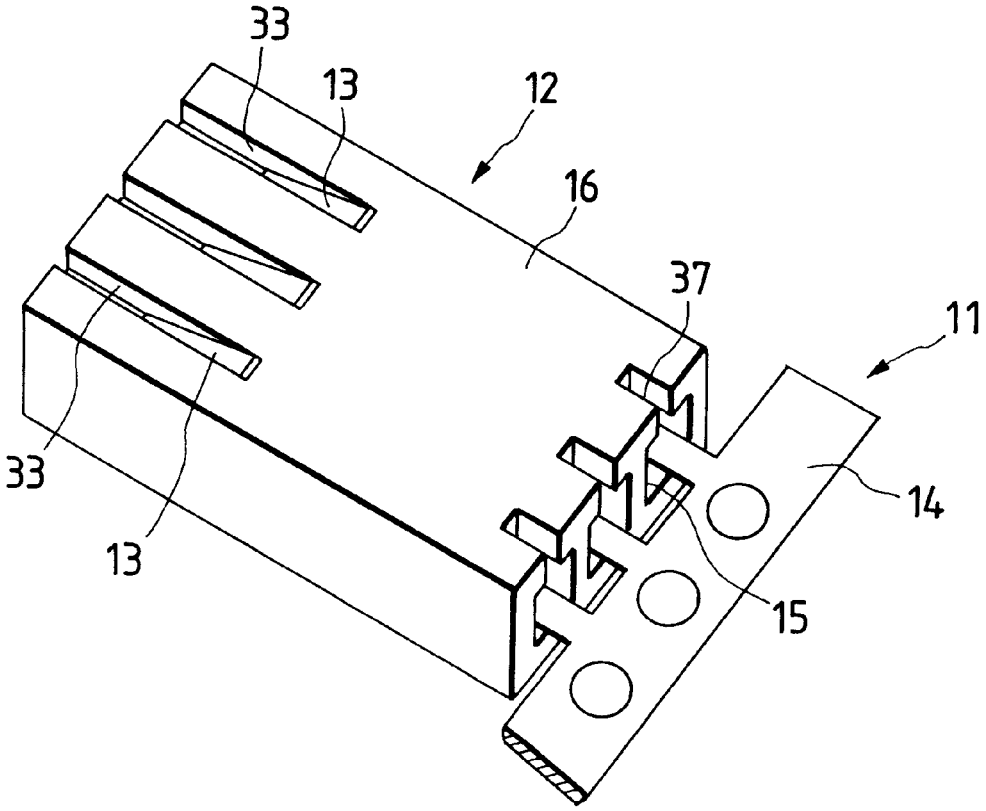
FIG. 1 is a perspective view showing the step of inserting press-connecting terminals in respective terminal receiving chambers in one embodiment of the present invention.

As shown in FIG. 1, the chain terminal 11 has a row of press-connecting terminals 13 formed at predetermined intervals on one side edge of an elongate, strip-like connecting piece 14, and the chain terminal 11 is fed so that the plurality of press-connecting terminals 13 can be mounted simultaneously in the housing 12. Therefore, the processing of many press-connecting terminals can be effected rapidly.

Figure 2:
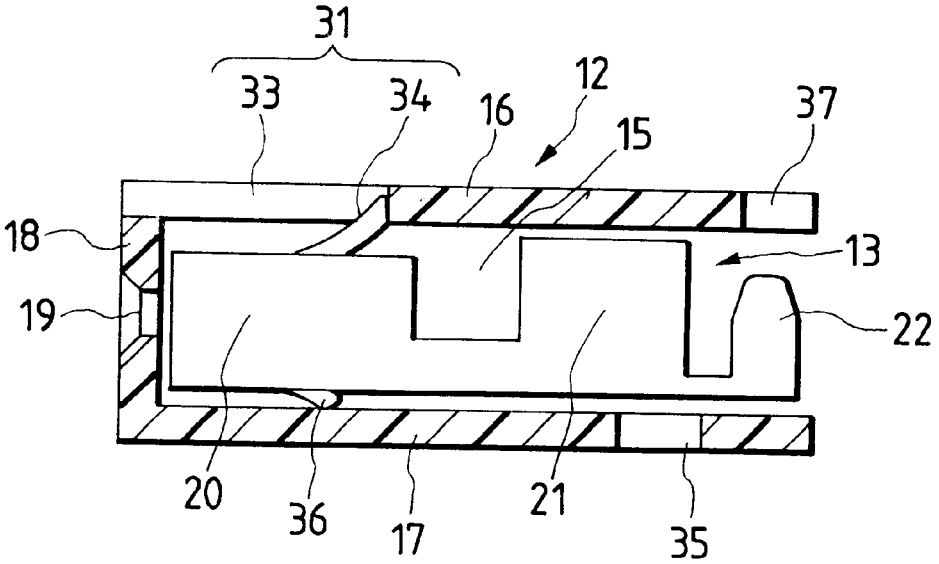
FIG. 2 is a cross-sectional view showing a condition in which the press-connecting terminal is completely inserted in the terminal receiving chamber.
Figure 4:
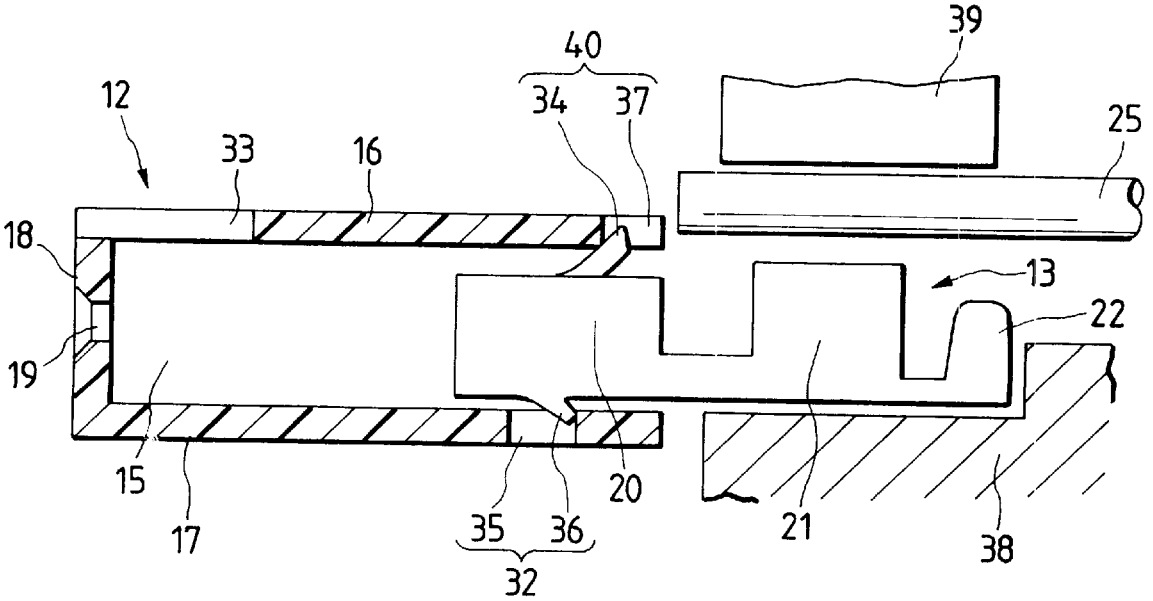
FIG. 4 is a cross-sectional view showing a condition in which an electric wire is to be press-connected to the drawn press-connecting terminal shown in FIG. 3.
Figure 5:
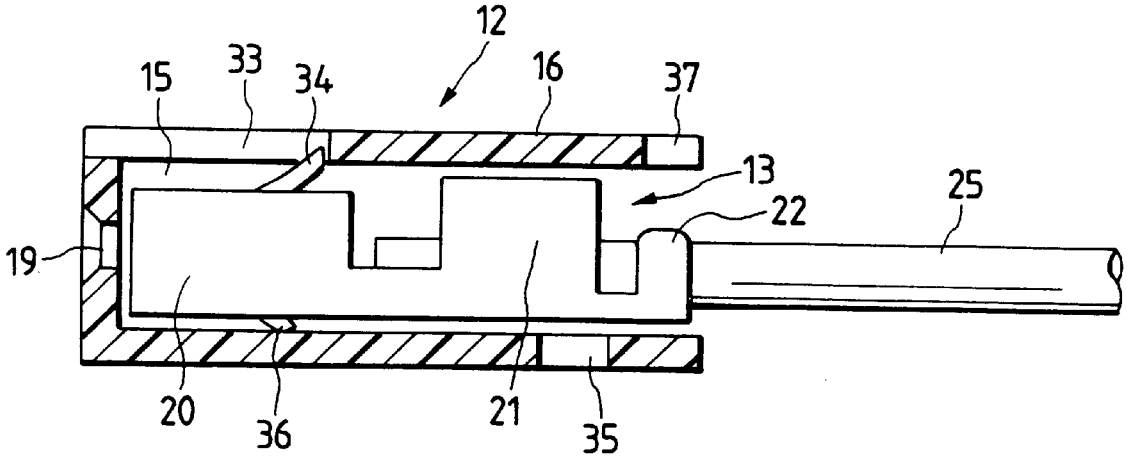
FIG. 5 is a cross-sectional view showing a condition in which the press-connecting terminal, to which the electric wire has been connected, is again inserted in the terminal receiving chamber.
Figure 6:
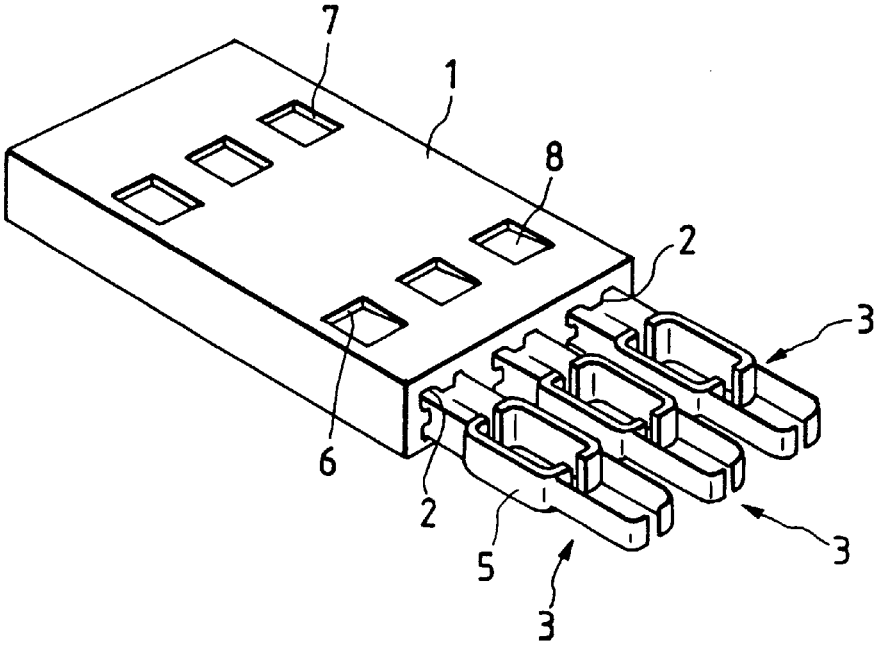
FIG. 6 PRIOR ART
FIG. 6 is a perspective view showing conventional press-connecting terminals before electric wires are connected respectively thereto.
Figure 7:
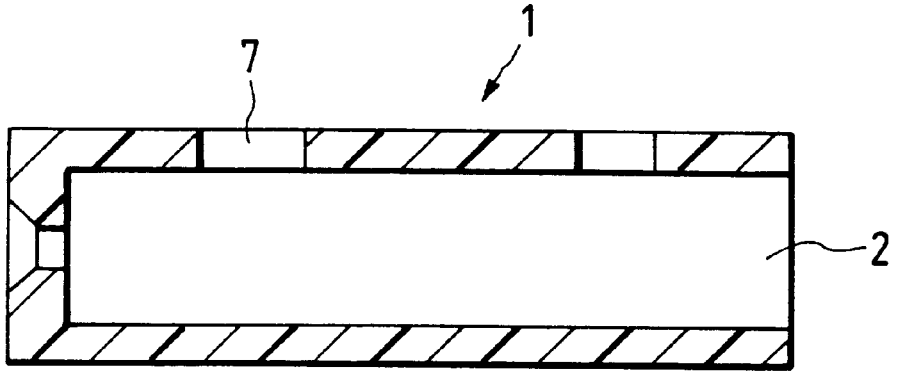
FIG. 7 PRIOR ART
FIG. 7 is a cross-sectional view of a housing served in the conventional press-connecting terminals.
Figure 8:
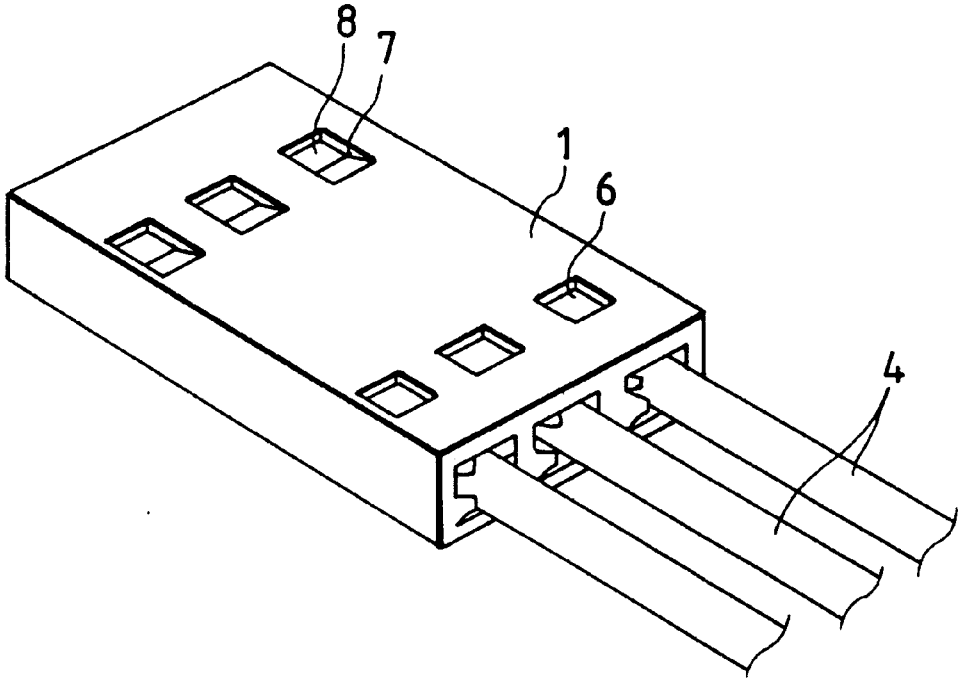
FIG. 8 PRIOR ART
FIG. 8 is a perspective view of a conventional press-connecting connector to which the electric wires are connected.

The housing 12 has a plurality of terminal receiving chambers 15 for respectively receiving the press-connecting terminals 13. As shown in FIGS. 2, 4 and 5, each of the terminal receiving chambers 15 is defined by an upper wall 16, a lower wall 17 and right and left partition walls (not shown), and is separated from its adjoining terminal receiving chamber or chambers 15. A front side of each terminal receiving chamber 15 is closed by a front wall 18 of the housing 12, and terminal insertion holes 19 are formed through the front wall 18, and mating connector terminals (not shown) can pass respectively through these terminal insertion holes 19 into the respective terminal receiving chambers 15. A rear side of each terminal receiving chamber 15 is open, and the press-connecting terminal 13 can be inserted into the terminal receiving chamber through this open rear side.

Each of the press-connecting terminals 13, formed on the chain terminal 11, includes a contact portion 20, a press-connecting portion 21 and a clamping portion 22 which are arranged in this order from its distal end toward the connecting piece 14. The contact portion 20 has a tubular shape, and the terminal in the mating connector, when inserted into the terminal receiving chamber 15 through the terminal insertion hole 19, contacts this contact portion 20 to be electrically connected thereto.

Figure 3:
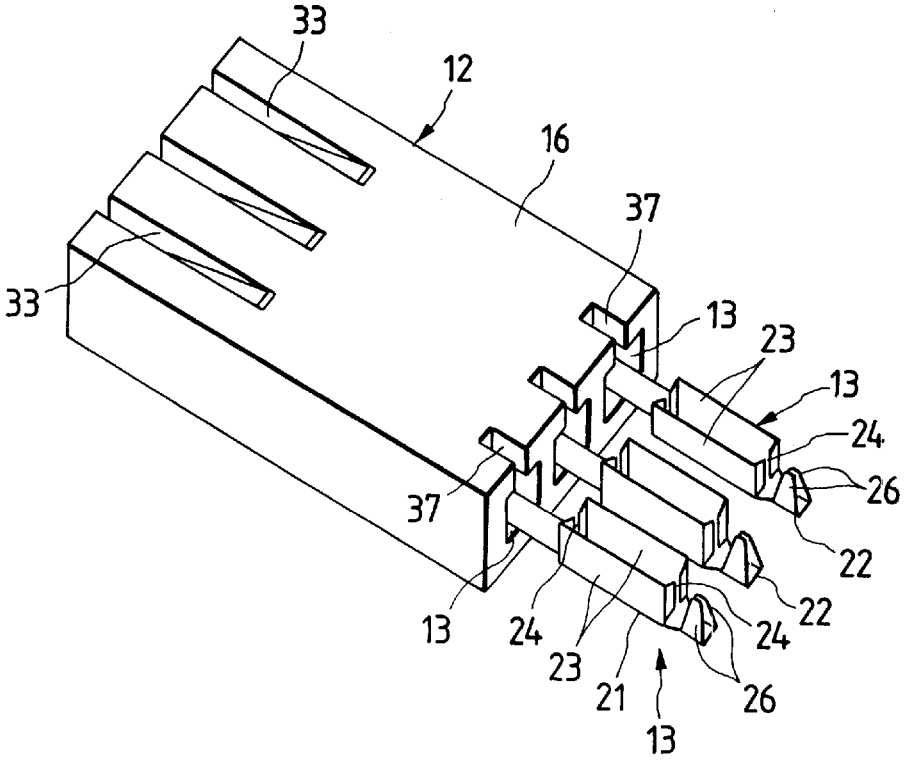
FIG. 3 is a perspective view showing a condition in which the press-connecting terminals are drawn respectively from the terminal receiving chambers after the condition shown in FIG. 2.

An electric wire 25 (see FIG. 4), when press-connected to the press-connecting portion 21, is electrically connected thereto. As shown in FIG. 3, the press-connecting portion 21 has a pair of right and left upstanding walls 23 extending upright from a bottom wall portion. Opposite end portions of each of the upstanding walls 23 are bent inwardly to form press-connecting blades 24, respectively. When the electric wire 25 is press-fitted into a space between the upstanding walls 23, the press-connecting blades 24 bite an insulating sheath of the electric wire, and contact a conductor inside the insulating sheath to be electrically connected thereto.

The clamping portion 22 has a pair of right and left clamping piece portions 26 extending upright from the bottom wall portion, and after the electric wire 25 is press-connected to the press-connecting portion 21, the clamping piece portions 26 are bent and pressed against the insulating sheath of the electric wire 25, thereby fixing the electric wire 25.

In addition to the above construction, this embodiment is provided with first engagement member 31 and second engagement member 32. These engagement members 31 and 32 serve to fix the press-connecting terminal 13 to the housing 12, and each of these members is provided at each press-connecting terminal 13 and the housing 12. More specifically, the first engagement member 31 is constituted by a first engagement hole 33 formed in the housing 12 and a first resilient projection (lance) 34 formed on the press-connecting terminal 13. The second engagement member 32 is constituted by a second engagement hole 35 formed in the housing 12 and a second resilient projection (lance) 36 formed on the press-connecting terminal 13.

When the resilient projection 34 is engaged in the engagement hole 33, the engagement member 31 is in an engaged condition, and also when the resilient projection 36 is engaged in the engagement hole 35, the engagement member 32 is in an engaged condition. Each of the engagement members 31 and 32 serves to fix the press-connecting terminal 13, inserted in the terminal receiving chamber 15, to the housing 12, and the engagement members 31 and 32 are provided for each of the terminal receiving chambers 15.

In this embodiment, the first engagement holes 33 are formed in the upper wall 16 of the housing 12, and the second engagement holes 35 are formed in the lower wall 17 of the housing 12 opposed to the upper wall 16. The first engagement holes 33 are formed in the upper wall 16 at a front end portion of the housing 12, and the second engagement holes 35 are formed in that portion of the lower wall 17 disposed near to a rear end of the housing 12. Therefore, the first engagement hole 33 and the second engagement hole 35 are spaced from each other in the longitudinal direction of the walls 16 and 17 forming the terminal receiving chamber 15.

The resilient projections 34 and 36 for being engaged respectively in the engagement holes 33 and 35, are formed on the contact portion 20 of the press-connecting terminal 13, and the first resilient projection 34 is formed on an upper face of the contact portion 20 while the second resilient projection 36 is formed on a lower face of the contact portion 20. The resilient projections 34 and 36 are formed by cut and erected predetermined parts of the contact portion 20, and these erected portions, having resiliency, project from the contact portion 20 to serve as the resilient projections 34 and 36 which can be engaged respectively in the corresponding engagement holes 33 and 35. The resilient projections 34 and 36 are formed respectively on those portions of the upper and lower faces of the contact portion 20 which are disposed in identical with each other with respect to the longitudinal direction of the terminal 13.

The resilient projections 34 and 36 are slanting in a direction opposite to the direction of insertion of the press-connecting terminal 13 into the terminal receiving chamber 15. Therefore, these resilient projections will not affect the insertion of the press-connecting terminal 13 into the terminal receiving chamber 15, and each of these resilient projections, when engaged in the associated engagement holes 33 and 35, fixes the press-connecting terminal 13 to the housing 12 against withdrawal from the terminal receiving chamber 15.

In this embodiment, the first engagement holes 33 are formed in the front end portion of the housing 12 as described above, and therefore when the first resilient projection 34 is engaged in the first engagement hole 33, the whole of the press-connecting terminal 13 is received in the terminal receiving chamber 15 as shown in FIGS. 2 and 5. Therefore, in the engaged condition of the first engagement member 31, the press-connecting terminal 13 is fixed to the housing 12 without being exposed to the exterior of the terminal receiving chamber 15.

On the other hand, the second engagement holes 35 are formed in that portion of the housing 12 near to the rear end thereof, and therefore when the first engagement member 31 is in the engaged condition, the second resilient projection 36 will not be engaged in the second engagement hole 35, and the second resilient projection 36 can be engaged in the second engagement hole 35 when the first engagement member 31 is in a non-engaged condition. When the second resilient projection 36 is engaged in the second engagement hole 35, the press-connecting portion 21 and the clamping portion 22 are exposed to the exterior of the terminal receiving chamber 15, as shown in FIG. 4. In this condition, the press-connecting terminal 13 is fixed to the housing 12. Thus, in the engaged condition of the second engagement member 32, the press-connecting terminal 13 is fixed to the housing 12, with the press-connecting portion 21 and the clamping portion 22 disposed externally of the terminal receiving chamber 15.

The first and second resilient projections 34 and 36, each having the resiliency, project respectively from the upper and lower faces of the contact portion 20, and therefore one of the resilient projections 34 and 36, when contacted with the inner face of the upper wall 16 or the lower wall 17, urges the other of the resilient projections 34 and 36 into engagement with the associated engagement hole 33, 35. Thus, each of the resilient projections 34 and 36 can be positively engaged in the associated engagement hole 33, 35 by the resiliency of the other resilient projection 36, 34, and this engaged condition can be positively maintained, and the press-connecting terminal 13 can be stably fixed to the housing 12.

In addition to the first and second engagement members 31 and 32, retaining holes 37 for respectively retaining the first resilient projections 34 are formed in the rear end portion of the upper wall 16 of the housing 12. The first resilient projection 34 is engaged in the retaining hole 37 in synchronism with the engagement of the resilient projection 36 of the second engagement member 32 in the engagement hole 35. This engagement prevents the movement of the press-connecting terminal 13 into the terminal receiving chamber 15. Therefore, the retaining hole 37 and the first resilient projection 34 jointly form a third engagement member 40 for preventing the movement of the press-connecting terminal 13 into the terminal receiving chamber 15.

Thus, the resilient projection 34 of the first engagement member 31 also serves as the constituent member of the third engagement member 40, and therefore there is no need to provide additional member for the engagement, thus achieving an advantage that the construction is simplified.

As described above, when the press-connecting portion 21 and the clamping portion 22 are exposed to the exterior of the terminal receiving chamber 15, the second engagement member 32 prevents the withdrawal of the press-connecting terminal 13 from the terminal receiving chamber 15 as shown in FIG. 4, and also the first resilient projection 34 is engaged in the retaining hole 37 to thereby prevent the movement of the press-connecting terminal 13 into the terminal receiving chamber 15. Therefore, the press-connecting terminal 13 is prevented from movement in the opposite (normal and reverse) directions, and the press-connecting terminal 13 can be located accurately in the predetermined position, and the electric wire 25 can be accurately and positively press-connected to the press-connecting portion 21.

Next, the procedure of assembling the press-connecting connector of this embodiment will be described. The chain terminal 11 is fed to the housing 12, and the press-connecting terminals 13 are aligned with the terminal receiving chambers 15, respectively, and then the press-connecting terminals 13 are simultaneously inserted into the terminal receiving chambers 15, respectively. As a result, the press-connecting terminals 13, formed on the chain terminal 11, are received in the terminal receiving chambers 15, respectively, as shown in FIG. 1. With the use of this chain terminal 11, the plurality of press-connecting terminals 13 can be simultaneously inserted respectively into the terminal receiving chambers 15 in the housing 12, and therefore the rapid insertion can be effected.

At this time, the press-connecting terminals 13 are fully inserted into the terminal receiving chambers 15, respectively. As a result, the first resilient projection 34 of each terminal is engaged in the first engagement hole 33, and the press-connecting terminal 13 is fixed to the housing 12 without being exposed to the exterior of the terminal receiving chamber 15. The fixing in this step is canceled as described later when the electric wire 25 is to be press-connected to the terminal, and this is the temporary, provisional fixing.

After the above provisional fixing, the press-connecting terminals 13 are cut from the chain terminal 11. FIG. 2 shows the cross-section obtained after this cutting, and in this condition, the first resilient projection 34 is engaged in the first engagement hole 33, and also the whole of each press-connecting terminal 13 is received in the terminal receiving chamber 15, and is fixed in position. In this completely-inserted condition, the housing 12 is supplied to an electric wire, press-connecting line (not shown). Therefore, when the housing is supplied to the electric wire press-connecting line, the press-connecting portion 21 and the clamping portion 22 of each terminal are not exposed to the exterior of the housing 12.

In the electric wire press-connecting line, a jig (not shown) is first inserted into the first engagement hole 33 from the upper side to press down the first resilient projection 34, thereby canceling the engagement of the first resilient projection 34 in the first engagement hole 33. Then, the press-connecting terminal 13 is drawn toward the rear side of the housing 12, so that the press-connecting portion 21 and the clamping portion 22 are exposed to the exterior of the terminal receiving chamber 15.

FIG. 3 shows this condition, and the second resilient projection 36 is engaged in the second engagement hole 35, that is, the second engagement member 32 is in the engaged condition, thereby preventing a further withdrawal of the press-connecting terminal 13. At the same time, the third engagement member 40 performs its function, that is, the first resilient projection 34 is engaged in the retaining hole 37. These engagements prevent the press-connecting terminal 13 from moving in the opposite (normal and reverse) directions, and therefore the terminal 13 is fixed in the predetermined position.

In the condition of FIG. 3, the press-connecting portions 21 and the clamping portions 22, exposed to the exterior of the terminal receiving chambers 15, are placed on a support bed 38. Then, the electric wire 25 is located in overlying relation to the press-connecting portion 21, and the electric wire 25 is pressed down by a press-connecting jig 39. As a result of this pressing-down, the electric wire 25 is press-connected to the press-connecting portion 21, and the press-connecting blades 24 bite the insulating sheath, and contacts the conductor inside the insulating sheath to be electrically connected thereto. Then, the clamping portion 22 is bent and pressed, thereby connecting the electric wire 25 to the press-connecting terminal 13.

After the connection of the electric wire 25, the press-connecting terminal 13 is pushed to be again inserted into the terminal receiving chamber 15. FIG. 5 shows this re-inserted condition, and the whole of the press-connecting terminal 13 is completely inserted in the terminal receiving chamber 15. As a result of this complete insertion, the first resilient projection 34 is again engaged in the first engagement hole 33. With this engagement, each press-connecting terminal 13 is fixed to the housing 12, and the press-connecting connector is assembled.

In this assembling operation, before the housing is supplied to the electric wire press-connecting line, the press-connecting portion 21 and the clamping portion 22 of each terminal are received in the terminal receiving chamber 15, and are not exposed to the exterior. Therefore, the press-connecting portions 21 and the clamping portions 22 will not be brought into contact with external members, and therefore will not be deformed or damaged by such contact, and the electric wire 25 can be positively press-connected to the press-connecting portion 21, and the rate of defective products is reduced.

When the press-connecting portion 21 is drawn out, the second resilient projection 36 is engaged in the second engagement hole 35, and also the first resilient projection 34 is engaged in the retaining hole 37, and therefore the press-connecting terminal 13 will not move in the opposite (normal and reverse) directions. Therefore, the press-connecting portion 21 is held in the predetermined position, and the electric wire 25 can be positively press-connected to the press-connecting portion 21.

In this embodiment, merely by pushing the press-connecting terminal 13 into the terminal receiving chamber 15, the press-connecting terminal 13 can be received in the terminal receiving chamber 13, and it is not necessary to press the first resilient projection 34 by a jig, and therefore the press-connecting terminal 13 can be easily received in the terminal receiving chamber 15.

In the above embodiment, after the press-connecting terminals 13 are completely inserted respectively into the terminal receiving chambers 15, the press-connecting terminals 13 are cut from the chain terminal 11. However, the press-connecting terminals 13 may be cut from the chain terminal 11 after the electric wires 25 are press-connected respectively to the press-connecting terminals 13.

The provision of the third engagement member 40 may be omitted if the second engagement member 32 can positively prevent the movement of the press-connecting terminal 13.

As has been described heretofore, according to the present invention, there is provided the first engagement member which can be brought into the engaged condition when the press-connecting terminal is completely inserted into the terminal receiving chamber so as to fix the press-connecting terminal in such a manner that the condition of complete insertion of the press-connecting terminal in the terminal receiving chamber is maintained, and there is also provided the second engagement member which can be brought into the engaged condition when the press-connecting portion is exposed to the exterior of the terminal receiving chamber so as to fix the press-connecting terminal. Therefore, in accordance with the assembling steps for the press-connecting connector, the condition of insertion of the press-connecting terminal in the terminal receiving chamber can be changed. Therefore, the whole of the press-connecting terminal is completely inserted in the terminal receiving chamber, and in this condition, the connector is supplied to the electric wire press-connecting line, and the press-connecting portion is thereby prevented from contact with external members, and the deformation and damage of the press-connecting portion due to such contact are eliminated, and the production of defective products due to these can be prevented.

According to the present invention, there is further provided the third engagement member for preventing the movement of the press-connecting terminal into the terminal receiving chamber, and therefore the movement of the press-connecting terminal in the opposite (normal and reverse) directions is prevented, and the press-connecting terminal can be located in the predetermined position, and the electric wire can be positively press-connected to the press-connecting terminal.

According to the present invention, each of the first engagement member and the second engagement member is provided at the housing and the press-connecting terminal, and therefore the engagement can be effected easily and positively.

According to the present invention, the first resilient projection of the first engagement member also serves as the third engagement member, and therefore the construction of the third engagement member can be simplified.

According to the present invention, the first resilient projection and the second resilient projection urge each other, and therefore each of the two resilient projections can be positively engaged in the engagement hole, and besides the engaged condition is stable.

According to the present invention, when the press-connecting terminal is provisionally fixed, the press-connecting terminal is completely inserted in the terminal receiving chamber, and is not exposed to the exterior of the housing, and therefore the press-connecting terminal will not contact external members, and the deformation and damage thereof is prevented.

According to the present invention, the chain terminal, having the plurality of press-connecting terminals formed thereon, is used, and therefore the plurality of press-connecting terminals can be simultaneously mounted in the housing, and the efficiency of the operation is enhanced.

According to the present invention, the press-connecting terminals are completely inserted respectively in the terminal receiving chambers, and in this condition these are supplied to the electric wire press-connecting line, and therefore the press-connecting terminals will not contact external members, and the deformation and damage of the press-connecting terminals are eliminated.

The present invention is not limited to the above embodiment but various changes and modifications are possible without departing from the sprit and the scope of the invention.

What is claimed is:

1. A press-connecting connector comprising:

a connector housing having a terminal receiving chamber;

a press-connecting terminal having a press-connecting portion adapted to press-connect to a wire, the press-connecting terminal inserted into the terminal receiving chamber and moveable between (1) a completely inserted condition in which the press-connecting terminal is completely inserted into the terminal receiving chamber, and (2) a partially inserted condition in which the press-connecting portion extends from the terminal receiving chamber;

a first engaging member for retaining the press-connecting terminal when the press-connecting terminal is in the completely inserted condition; and a second engaging member for retaining the press-connecting terminal when the press-connecting terminal is in the partially inserted condition;

wherein the fist engaging member is separate from the second engaging member.

2. The press-connecting connector as set forth in claim 1, further comprising:

a third engagement member for retaining the press-connecting terminal simultaneously with the second engaging member so as to prevent the press-connecting terminal from moving inside of the terminal receiving chamber, the third engagement member being separate from the second engagement member.

3. The press-connecting connector as set forth in claim 2, wherein the first engagement member includes a first engagement hole formed on an inner face of the terminal receiving chamber, and a first resilient projection projected from the press-connecting terminal to engage with the first engagement hole; and wherein the second engagement member includes a second engagement hole formed on the inner face of the terminal receiving chamber so as to be separated from the first engagement hole in a longitudinal direction, and a second resilient projection projected from the press-connecting terminal to engage with the second engagement hole.

4. The press-connecting connector as set forth in claim 3, wherein the third engagement member includes a third engagement hole formed on the inner face in which the first engagement hole is formed and the first resilient projection for engaging with the third engagement hole.

5. The press-connecting connector as set forth in claim 3, wherein the first engagement hole is formed on a first inner face of the terminal receiving chamber and the second engagement hole is formed on a second inner face opposing the first inner face.

6. The press-connecting connector as set forth in claim 3, wherein the first and the second resilient projections are slantingly projected contrary to an insertion direction of the press-connecting terminal.

7. A method for assembling a press-connecting connector including (1) a press-connecting terminal member having a press connecting portion, (2) a connector housing having a terminal receiving chamber, (3) a first engaging member for retaining the press-connecting terminal member in a completely inserted condition, and (4) a second engaging member for retaining the press-connecting terminal member in a partially inserted condition in which at least the press-connecting portion extends from the terminal receiving chamber, the method comprising the steps of:

inserting the press-connecting terminal member completely into the terminal receiving chamber, such that the first engagement member provisionally retains the press-connecting terminal member in the completely inserted condition;

withdrawing the press-connecting terminal member from the terminal receiving chamber, such that the second engagement member retains the press-connecting terminal member in the partially inserted condition;

press-connecting an electric wire onto the exposed press-connecting portion; and inserting the press-connecting terminal member, to which the electric wire is connected, completely into the terminal receiving chamber, such that the first engagement member retains the press-connecting terminal member in the completely inserted condition.

8. The method for assembling the press-connecting connector as set forth in claim 7, wherein the press-connecting terminal member includes a plurality of press-connecting terminals and a chain terminal member connecting the terminals together, the method further comprising the step of:

separating the chain terminal member from the terminals after the the press-connecting terminal member is provisionally retained in the completely inserted condition.

9. The method for assembling the press-connecting connector as set forth in claim 7, wherein the press-connecting terminal member includes a plurality of press-connecting terminals and a chain terminal member connecting the terminals together, the method further comprising the step of:

separating the chain terminal member from the terminals after the press-connecting of the electric wire.

10. The method for assembling the press-connecting connector as set forth in claim 7, further comprising the step of:

supplying the press-connecting connector to a manufacturing line for the press-connecting after the press-connecting terminal member is provisionally retained in the completely inserted condition.

* * * * *